US009950213B2

(12) United States Patent
Skulman

(10) Patent No.: US 9,950,213 B2
(45) Date of Patent: Apr. 24, 2018

(54) SYSTEMS AND METHODS FOR DELIBERATE STRIDE OVER-EXTENSION

(71) Applicant: Robert Albert Skulman, Fort Smith, AR (US)

(72) Inventor: Robert Albert Skulman, Fort Smith, AR (US)

( * ) Notice: Subject to any disclaimer, the term of this patent is extended or adjusted under 35 U.S.C. 154(b) by 0 days.

(21) Appl. No.: 14/488,845

(22) Filed: Sep. 17, 2014

(65) Prior Publication Data

US 2015/0080181 A1 Mar. 19, 2015

Related U.S. Application Data

(60) Provisional application No. 61/960,392, filed on Sep. 17, 2013.

(51) Int. Cl.

| | |
|---|---|
| ***A63B 24/00*** | (2006.01) |
| ***A63B 22/02*** | (2006.01) |
| ***A63B 71/06*** | (2006.01) |
| ***A63B 23/04*** | (2006.01) |

(52) U.S. Cl.

CPC ..... *A63B 24/0075* (2013.01); *A63B 22/02* (2013.01); *A63B 23/0458* (2013.01); *A63B 71/0622* (2013.01); *A63B 22/0285* (2013.01); *A63B 2071/065* (2013.01); *A63B 2071/0638* (2013.01); *A63B 2071/0655* (2013.01); *A63B 2071/0658* (2013.01); *A63B 2071/0661* (2013.01); *A63B 2071/0694* (2013.01); *A63B 2220/05* (2013.01); *A63B 2220/10* (2013.01); *A63B 2220/12* (2013.01); *A63B 2220/40* (2013.01); *A63B 2220/836* (2013.01); *A63B 2225/20* (2013.01)

(58) Field of Classification Search

CPC ..... A63B 21/00047; A63B 23/0464; A63B 22/0235; A63B 26/003; A63B 24/0075; A63B 22/02; A63B 2220/05; A63B 2220/10; A63B 2220/12; A63B 2220/40; A63B 2220/836; A63B 2225/20; A63B 2071/0638; A63B 2071/065; A63B 2071/0655; A63B 2071/0658; A63B 2071/0661; A63B 2071/0694; A63B 23/0458

USPC ..... 434/247

See application file for complete search history.

(56) References Cited

U.S. PATENT DOCUMENTS

| | | | | | |
|---|---|---|---|---|---|
| 3,747,233 | A * | 7/1973 | Berryman | A63B 23/0464 | 434/255 |
| 5,924,960 | A * | 7/1999 | Cohen | A63B 21/00047 | 434/255 |
| D498,792 | S * | 11/2004 | Toniolo | D19/59 | |
| 8,317,660 | B2 * | 11/2012 | Goranson | A63B 6/00 | 434/148 |
| 8,794,975 | B2 * | 8/2014 | Davey | A63B 23/0244 | 434/236 |

(Continued)

*Primary Examiner* — Glenn Richman

(74) *Attorney, Agent, or Firm* — Dunlap Codding, P.C.

(57) ABSTRACT

A stretch stride system comprising a mat having a first stride pattern and a second stride pattern positioned thereon. The first stride pattern may include two or more step patterns spaced at a first interval. The second stride pattern may include two or more step pattern spaced at a second interval. The first interval and the second interval may be determined using different extended step lengths.

7 Claims, 7 Drawing Sheets

(56) References Cited

U.S. PATENT DOCUMENTS

| | | | | |
|---|---|---|---|---|
| 9,028,432 | B2 * | 5/2015 | Woo | A61B 5/0002 600/595 |
| 9,352,206 | B2 * | 5/2016 | Uehling, III | A63B 69/38 |
| 2004/0009845 | A1 * | 1/2004 | Johnson | A63B 26/003 482/41 |
| 2012/0021873 | A1 * | 1/2012 | Brunner | A63B 22/0235 482/9 |

* cited by examiner

SYSTEMS AND METHODS FOR DELIBERATE STRIDE OVER-EXTENSION

CROSS-REFERENCE TO RELATED APPLICATIONS

The present patent application incorporates by reference the entire provisional patent application identified by U.S. Ser. No. 61/960,392, filed on Sep. 17, 2013, and claims priority thereto under 35 U.S.C. 119(e).

BACKGROUND

Performance measures are critical in determining the potential of athletes and efficacy of training programs. Training programs that can improve performance measures are highly sought out within the fitness and athletic industry as an increased emphasis is being placed on physical performance measures as an outcome predictor. A simple performance measure, such as stride length, may be beneficial in the determination of athletic performance.

In biomechanics, stride length is the distance between successive points of contact of a foot. For example, stride length is the distance between two successive placements of a single foot, consisting of step lengths.

Generally, in regards to stride length, current machines within the art focus on identification or adaptation to a user's normal stride length. For example, in U.S. Pat. No. 8,062,167, the system described allows for a user to adjust setting of the machine to provide for a user's stride length. In another example, in U.S. Pat. No. 7,156,775, the system describes a starting block for track running. The starting block includes two pads with exact markings for where a runner should place their feet to start in a track meet.

Stride evaluation systems within the industry are also used to evaluate a person's stride length. For example, in U.S. Pat. No. 4,774,679, straps and sensors positioned on a user's body are used to aid in evaluation of a person's stride length. Other evaluation system examples include those systems described in U.S. Pat. Nos. 7,896,784 and 7,785,235. Abnormal conditions of a person's stride length may also be evaluated such as in the system described in U.S. Pat. No. 6,231,527.

The stride evaluation systems and methods described and known within the industry are used to evaluate and dissect the stride length of a user so that the user can extend or adjust their stride. Generally, an increased stride length is an end goal of the system and is not an element of the system.

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices.

DETAILED DESCRIPTION OF INVENTIVE CONCEPT(S)

Figure 1A:
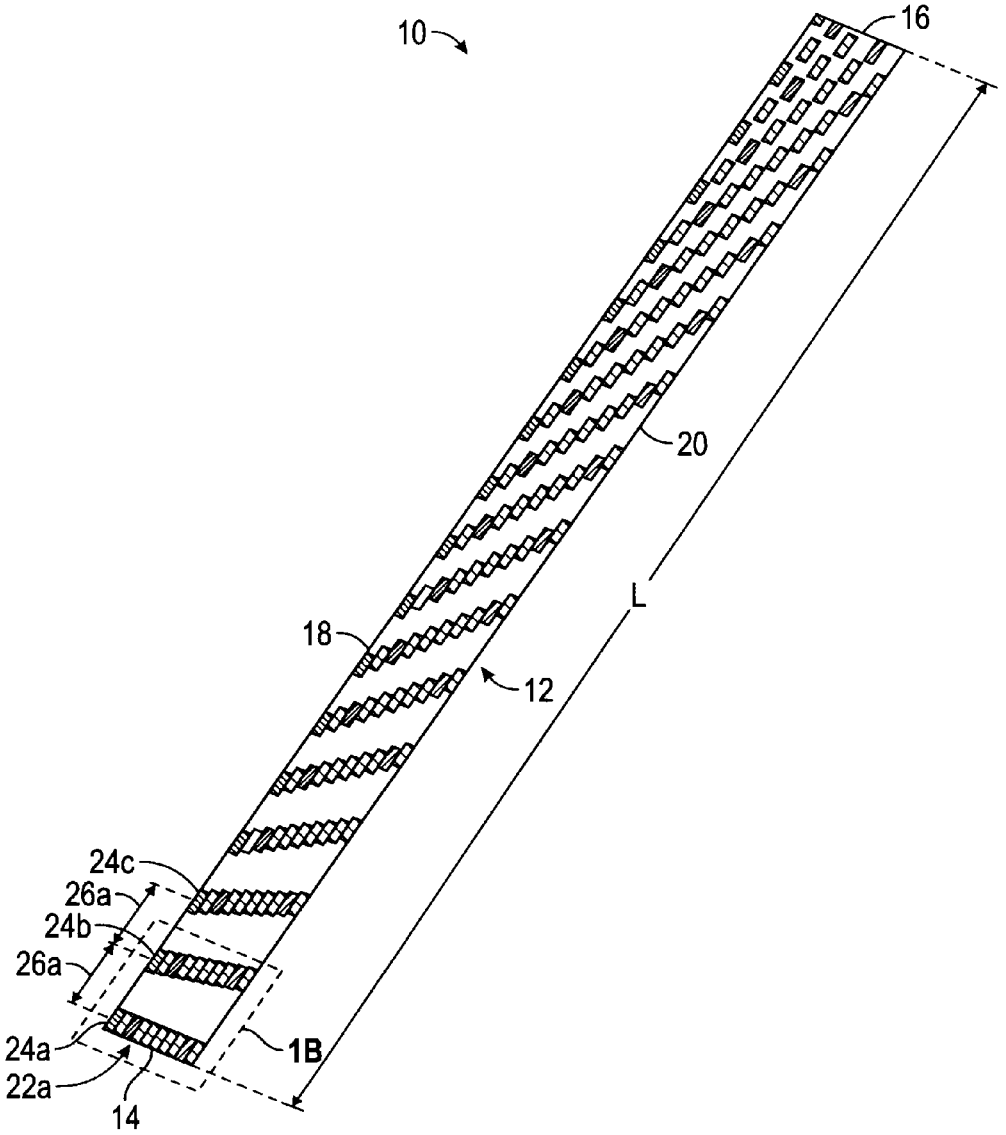
FIG. 1A is a perspective view of an exemplary stride stretch system in accordance with the present disclosure. The stride stretch system includes a mat having multiple stride patterns positioned thereon.

Before explaining at least one embodiment of the inventive concept(s) disclosed herein in detail, it is to be understood that the presently disclosed and claimed inventive concept(s), process(es), methodology(ies), and/or outcome(s) is not limited in its application to the details of construction and the arrangement of the components or steps or methodologies set forth in the following description or illustrated in the drawings. The presently disclosed and claimed inventive concept(s), process(es), methodology(ies), and/or outcome(s) disclosed herein may be capable of other embodiments or of being practiced or carried out in various ways. Also, it is to be understood that the phraseology and terminology employed herein is for the purpose of description and should not be regarded as limiting the presently disclosed and claimed inventive concept(s), process(es), methodology(ies), and/or outcome(s) herein in any way. With respect to any reference—patent or otherwise—mentioned herein, such reference should be considered to be incorporated by reference herein in its entirety as if set forth explicitly herein.

In the following detailed description of embodiments of the presently disclosed and claimed inventive concept(s), process(es), methodology(ies), and/or outcome(s), numerous specific details are set forth in order to provide a more thorough understanding of the presently disclosed and claimed inventive concept(s), process(es), methodology(ies), and/or outcome(s). However, it will be apparent to one of ordinary skill in the art that the presently disclosed and claimed inventive concept(s), process(es), methodology(ies), and/or outcome(s) within the disclosure may be practiced without one or more of these specific details, by skipping one or more of these specific details, or by modifying or transforming one or more of these specific details in a manner that would be apparent to one or ordinary skill in the art given the present disclosure and teachings. In other instances, well-known features have not been described in detail to avoid unnecessarily complicating the instant disclosure and teachings and the following specification should be construed as including all relevant and/or known details or teachings that would be within the skill and knowledge of one of ordinary skill in the art.

The presently disclosed and claimed inventive concept(s), process(es), methodology(ies), and/or outcome(s) disclosed herein are generally directed to a stride stretch system for deliberate over-extension. For example, such concepts may include deliberate over-extension of leg-muscles, tendons and/or ligaments during motion, such as walking, with an extended distance between a first footfall and a subsequent footfall as compared to a normal step length. In some embodiments, the stride stretch system may provide deliberate walking to an extended step length of a user's normal step length. In one example, the system may include one or more mats having markings representing step lengths for indication of foot placement when walking to increase step length. In another example, the system may include a treadmill device wherein an image may be projected onto the tread designating placement of footfall. Alternatively, a projection bar may be added to a standard treadmill with the projection bar providing the image projected onto the tread designating placement of footfall. In another example, the system may include a signaling device configured to alert a user as to footfall placement.

As used herein, the terms "comprises," "comprising," includes," including," "has," "having," or any other variation thereof, are intended to cover a non-exclusive inclusion. For example, a process, method, article, or apparatus that comprises a list of elements is not necessarily limited to only those elements, but may include other elements not expressly listed.

As used herein the notation "a-n" appended to a reference numeral is intended as merely convenient shorthand to reference one, or more than one, and up to infinity, of the elements or features identified by the respective reference numeral (e.g., 134*a-n*). Similarly, a letter following a reference numeral is intended to reference an embodiment of the features of an element that may be similar, but not necessarily identical, to a previously described element or feature bearing the same reference numeral (e.g., 148, 148*a*, 148*b*, etc.). Such shorthand notations are used for purposes of clarity and convenience only, and should not be construed to limit the presently disclosed and claimed inventive concept(s), process(es), methodology(ies), and/or outcome(s) in any way, unless expressly stated to the contrary.

Further, unless expressly stated to the contrary, "or" refers to an inclusive "or" and not to an exclusive "or." For example, a condition A or B is satisfied by anyone of the following: A is true (or present) and B is false (or not present), A is false (or not present) and B is true (or present), and both A and B are true (or present).

In addition, use of the term "a" or "an" are employed herein to describe elements and components of the embodiments herein. This is done merely for convenience and to give a general sense of the presently disclosed and claimed inventive concept(s), process(es), methodology(ies), and/or outcome(s). This description should be read to include one or at least one and the singular also includes the plural unless it is readily apparent to one or ordinary skill in the art that it is meant otherwise.

Finally, as used herein, any reference to "one embodiment," "some embodiments," or "an embodiment" means that a particular element, feature, structure, or characteristic described in connection with the embodiments is included in at least one embodiment of the presently disclosed and claimed inventive concept(s), process(es), methodology(ies), and/or outcome(s). The appearance of the phrases "in one embodiment," "in some embodiments," and "in an embodiment" in various places in the specification do not necessarily refer to the same embodiment unless it would be readily apparent to one of ordinary skill in the art that it is meant otherwise.

Figure 1B:
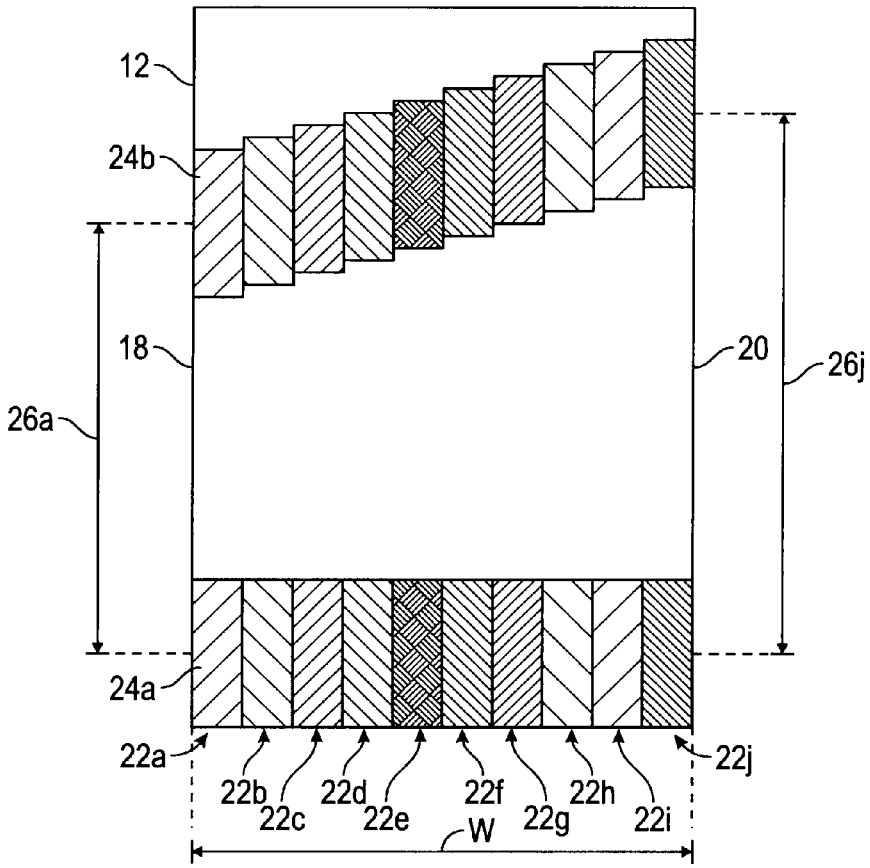
FIG. 1B is a top down view of a section of the stride stretch system illustrated in FIG. 1A.

FIGS. 1A and 1B illustrate, by way of example only, a stride stretch system 10 for deliberate over-extension of leg-muscles, tendons and/or ligaments during walking with an extended distance between a first footfall and a subsequent footfall as compared to a normal step length.

Generally, the stride stretch system 10 may comprise one or more mats 12. Each mat 12 may be formed of resilient material for walking thereon.

Figure 2:
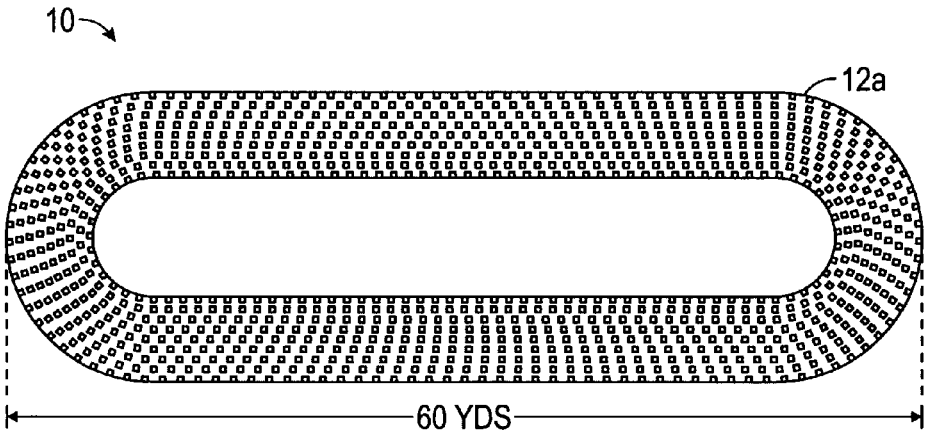
FIG. 2 is a top down view of another exemplary stride stretch system in accordance with the present disclosure. The stride stretch system includes an oval track surface having stride patterns positioned thereon.

In some embodiments, the mat 12 may be a temporary fixture positioned upon a surface. Alternatively, the mat 12 may be a permanent fixture positioned on the ground. For example, FIG. 2 illustrates a mat 12*a* as permanent surfacing for a quarter-mile track. For simplicity in description, the mat 12 will be described in relation to a rectangular mat 12, however one skilled in the art will understand the mat 12 may be in any shape including circular, oval, square, or follow any fanciful shape.

Each mat 12 may have a first end 14 and a second end 16 with a length L spanning from the first end 14 to the second end 16. Additionally, each mat 12 may have a first side 18 and a second side 20 with a width spanning from the first side 18 to the second side 20. Dimensions of each mat 12 may be based on use. For example, in some embodiments, the mat 12 may have dimensions of suitable for use in short distances (e.g., 40 inches by 600 inches). Alternatively, the mat 12 may include a length L and a width suitable for longer distances (e.g., the length L of a quarter-mile track).

Each mat 12 may include one or more stride patterns 22. For example, FIGS. 1A and 1B illustrate the stride patterns 22*a*-22*j*. Each stride pattern 22 may include two or more step patterns 24 with an interval 26 positioned therebetween. For example, as illustrated in FIG. 1A, the stride pattern 22*a* includes at least step patterns 24*a* and 24*b*. Each step pattern 24 within the stride pattern 22 may be formed as any shape, color or size. For example, in some embodiments, each step pattern 24 within the stride pattern 22 may be a rectangle having the same pattern as illustrated in FIG. 1A. In some embodiments, the step pattern 24 may be in the shape of a foot (e.g., left foot, right foot). In some embodiments, different stride patterns 22 may be distinguished using different patterns, colors, or other distinguishing features, such as, for example, in mats 12 having multiple stride patterns 22. For example, in FIG. 1A, different stride patterns 22 are distinguished using different patterns for each step patterns 24.

Distance between each successive step pattern 24 within a stride pattern 22 includes an interval 26 positioned therebetween. Generally, the length of each interval 26 is measured from the center of each step patterns 24. For example, the interval 26*a* of stride pattern 22*a* extends from the center $C_1$ of the step pattern 24*a* to the center $C_2$ of the step pattern 24*b*.

In some embodiments, each interval 26 may be substantially uniform within each stride pattern 22; however, intervals 26 may vary as compared to other stride patterns 22 on the mat 12. For example, each interval 26*a* within stride pattern 22*a* may be substantially uniform between step patterns 24 of the stride pattern 22*a* (e.g., the interval 26 between stride patterns 22*a* and 22*b* may be substantially similar or the same in length to the interval 26 between stride patterns 22*b* and 22*c* as shown in FIG. 1A). The interval 26, however, may be different in length as compared to other intervals 26 of additional stride patterns 22 on the mat 12. For example, the length of the interval 26*a* used in the stride pattern 22*a* may be smaller than the length of an interval 26*j* used in the stride pattern 22*j*.

Figure 3B:
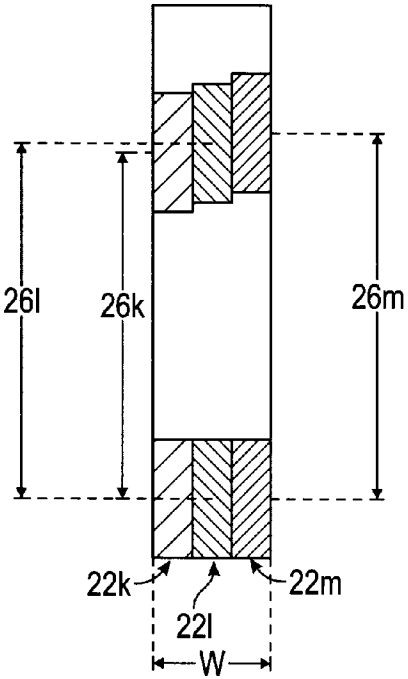
FIG. 3B is a top down view of a section of the stride stretch system illustrated in FIG. 3A.
Figure 3A:
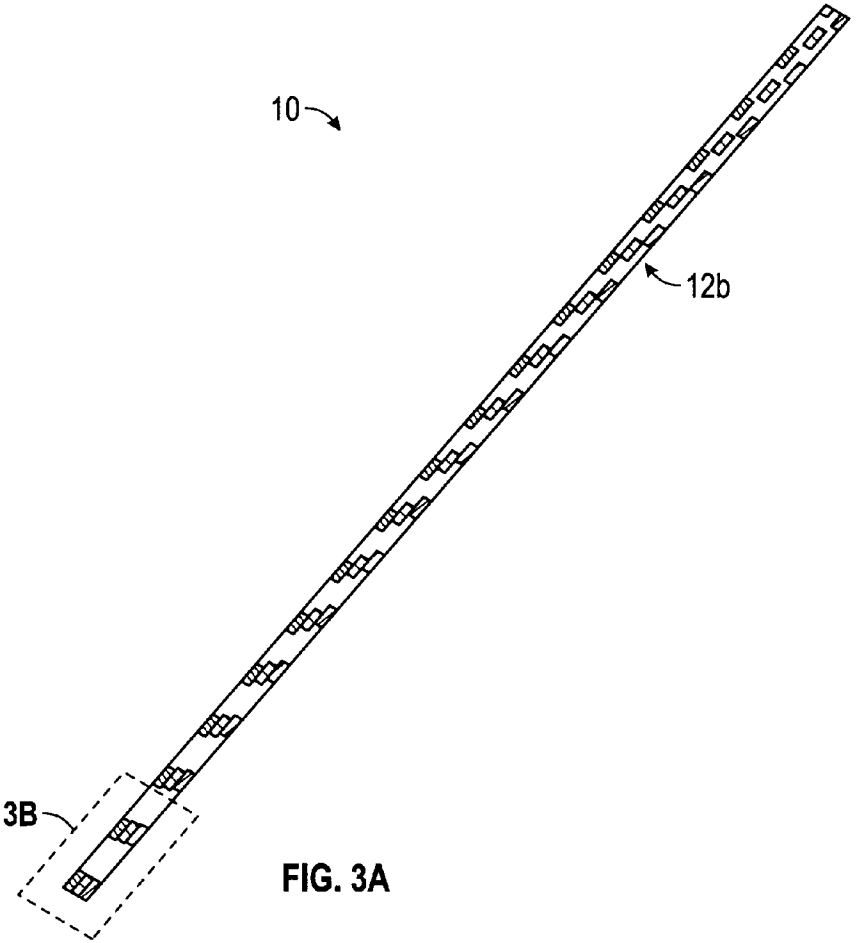
FIG. 3A is a perspective view of another exemplary stride stretch system in accordance with the present disclosure. The stride stretch system includes a mat having three different stride patterns positioned thereon.

Providing different lengths for intervals 26 of different stride patterns 22 may allow for two or more users having different strides to use the mat 12. Alternatively, providing for different lengths for intervals 26 in different stride patterns 22 may allow for a single user to progressively increase or decrease the user's stride moving from the first stride pattern 22 to successive increasing or decreasing stride patterns 22. For example, FIGS. 3A and 3B illustrate the mat 12*b* having three stride patterns 22*k*-22*m* having three distinct intervals 26*k*-26*m*. A user may use the mat 12*b* to gradually increase their stride by specific intervals 26 (e.g., by 120%, 140% and 160%).

Figure 4:
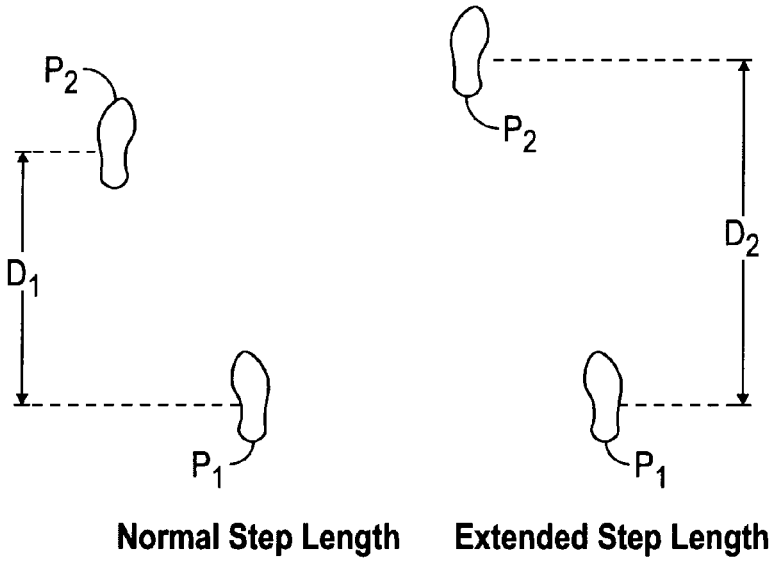
FIG. 4 is a diagrammatic view of a normal step length as compared to an extended step length.

Referring to FIGS. 1A, 1B and 4, in some embodiments, the length of each interval 26 may be determined using a step ratio. The step ratio may be based on a normal step length and an extended step length as illustrated in FIG. 4. Generally, normal step length is a distance $D_1$ between a contact point $P_1$ of one foot and a contact point $P_2$ of an opposite foot. The contact points $P_1$ and $P_2$ are provided at the center of each foot in FIG. 4, however, one skilled in the art will appreciate that the contact points $P_1$ and $P_2$ may be positioned at any point along the foot to determine normal step length of a user. The normal step length generally is the natural step length of the user. If one or more normal step lengths are measured, an average may be determined to provide an average normal step length. The average normal step length may then be used in the determination of the step ratio.

The distance $D_2$ of the extended step length may then be determined by increasing the normal step length by a step ratio (e.g., a pre-determined percentage). For example, the distance $D_2$ of the extended step length may be determined by increasing by approximately 120%-160% the distance $D_1$ of the normal step length, and as such, increasing the distance between contact points $P_1$ and $P_2$. Intervals 26 for each stride pattern 22 of the mat 12 may be based on the distance $D_2$ of the extended step length.

Figure 5:
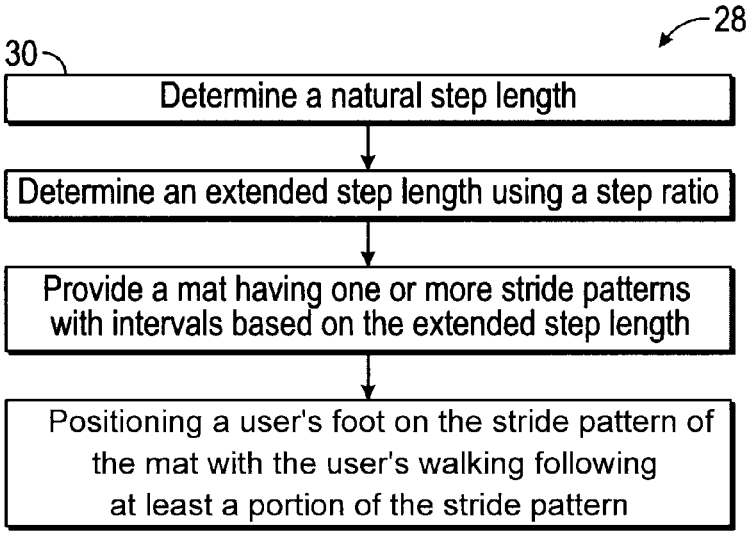
FIG. 5 is a flow chart of an exemplary method for using a stride stretch system in accordance with the present disclosure.

FIG. 5 illustrates a flow chart 28 of exemplary method for using the stretch stride system 10 of FIGS. 1-4. Generally, a user may exercise lower-body parts including, but not limited to, legs, hip flexors, gluteus maximus, calves, tendons, ligaments, fascia, and/or joints, using one or more stride patterns 22 on the mat 12 of stride stretch system 10. By using the one or more stride patterns 22 on the mat 12, the natural step length of the user may stretch, loosen, and/or strengthen lower-body parts including, but not limited to, legs, hip flexors, gluteus maximus, calves, tendons, ligaments, fascia, and/or joints, for example.

In a step 30, a user may determine the distance $D_1$ of a natural step length. The distance $D_1$ of the natural step length may be determined using methods known within the industry. For example, the distance $D_1$ of the natural step length may be determined by providing a starting point, having a user take a set number of steps (e.g., ten steps), having the user stop, and then measuring the total distance traveled by all steps of the user. An average natural step length may be determined using the total distance traveled and the set number of steps taken. The average natural step length may be used as the distance $D_1$ of the natural step length for subsequent steps.

In a step 32, the distance $D_2$ of the extended step length may be determined using a step ratio based on the distance $D_1$ of the natural step length. The step ratio may be an increase between approximately 120% and 160% of the distance $D_1$ of the natural step length. The distance $D_2$ of the extended step length may correlate to one or more intervals 26 of the mat 12.

In a step 34, the mat 12 may be provided having one or more stride patterns 22. Each stride patterns 22 may include two or more step patterns 24 positioned at one or more intervals 26 based on the distance $D_2$ of the extended step length of step 32.

In a step 36, the user may position each foot on corresponding step patterns 24 of at least one stride pattern 22 and walk (e.g., using decisive steps) following at least a portion of or the entire stride pattern 22 of the mat 12. In some embodiments, the user may repeat the stride pattern 22 on the mat 12. In some embodiments, the user may continue this motion for one or more timed sessions. For example, the user may continue this motion for a thirty minute session to a two hundred and forty minute session, or any amount in-between, shorter and/or greater. In some embodiments, the user may continue this motion for a pre-determined distance.

Use of the mat 12 having stride patterns 22 with intervals 26 at the extended step length may exercise the lower-body including legs, hip flexors, gluteus maximus, calves, tendons, ligaments, fascia, joints, and/or the like, for example, through the step patterns 24 that extend distance $D_1$ of the natural step length of the user. Such extension may stretch, loosen, and/or strengthen lower-body parts. In some embodiments, measured improvements may be determined for the user after immediate, short term, and/or long term use of the mat 12. For example, measured improvements may be determined for height of a vertical jump, distance of a horizontal jump, speed of a sprint, speed and/or endurance of a distance run, and/or other athletic and/or rehabilitative body improvements. Additional time and/or sessions may increase rate and/or amount of measured improvements. For example, multiple sessions over the course of days, weeks, months and/or years may increase the rate and/or amount of measured improvements.

Figure 6:
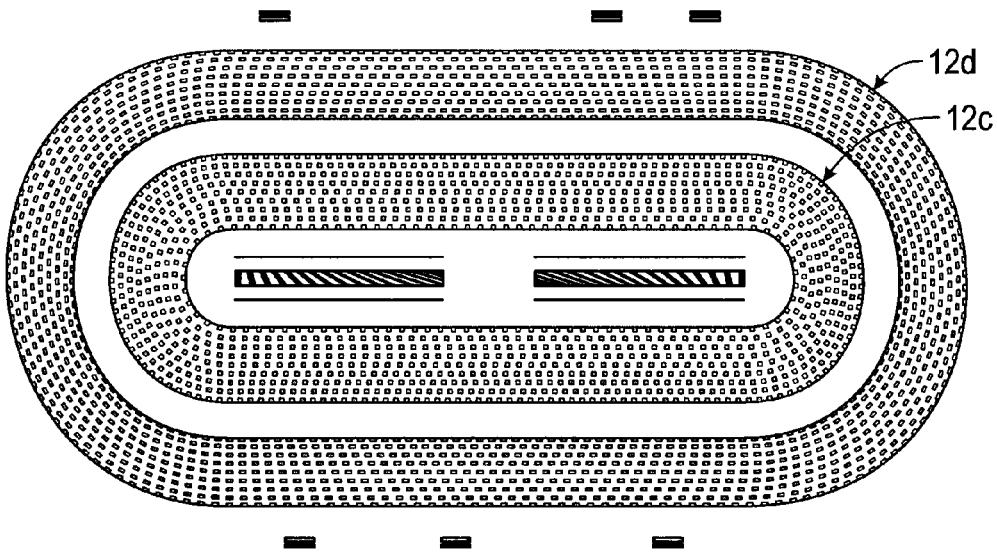
FIG. 6 is a diagrammatic view of another exemplary stride stretch system in accordance with the present disclosure. The stride stretch system having multiple oval tracks with stride patterns positioned thereon.

FIG. 6 illustrates another exemplary embodiment of a stride stretch system 10*c* having multiple mats 12*c* and 12*d* for different types of physical activity (e.g., walking). In some embodiments, the mats 12*c* and 12*d* may be surfacing on a track or other prepared source or circuit for athletes. FIG. 6 illustrates an exemplary oval track layout, however, it should be noted that other prepared sources or circuits for athletes may be used including straight-away tracks, meandering tracks having one or more curves, and/or the like, for example. The first mat 12*c* may be positioned on or included in the surfacing of an inner track and used for a first physical activity, person, or team. The second mat 12*d* may be positioned on or included in the surfacing of an outer track and used for a second physical activity, person, or team as illustrated in FIG. 6

Figure 7A:
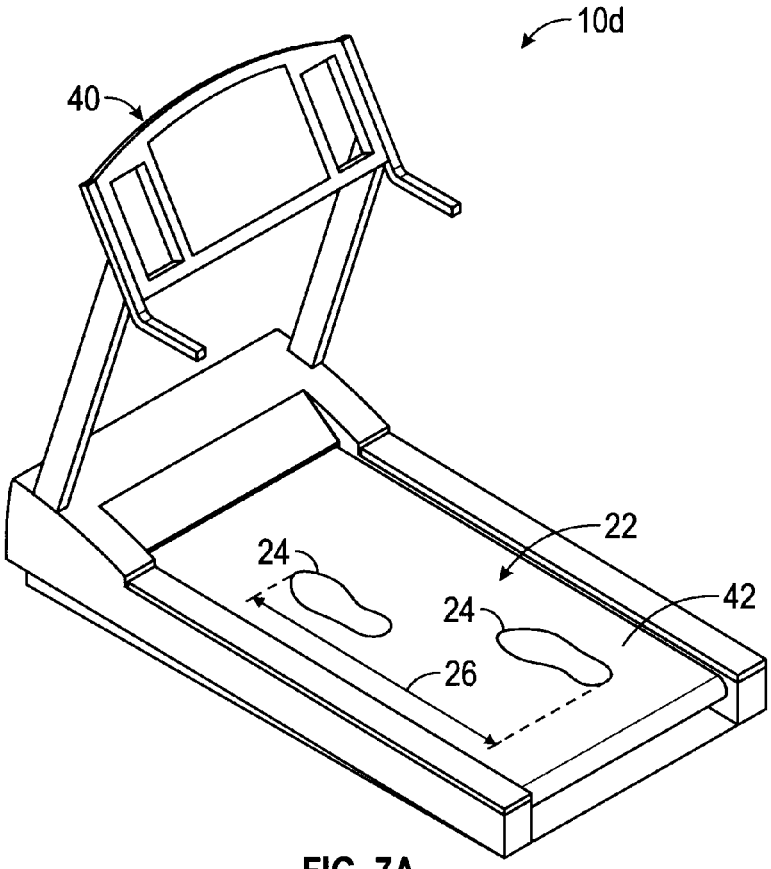
FIG. 7A is a perspective view of another exemplary stride stretch system in accordance with the present disclosure. The stride stretch system having a treadmill with a belt, wherein a stride pattern is positioned on the belt.
Figure 7B:
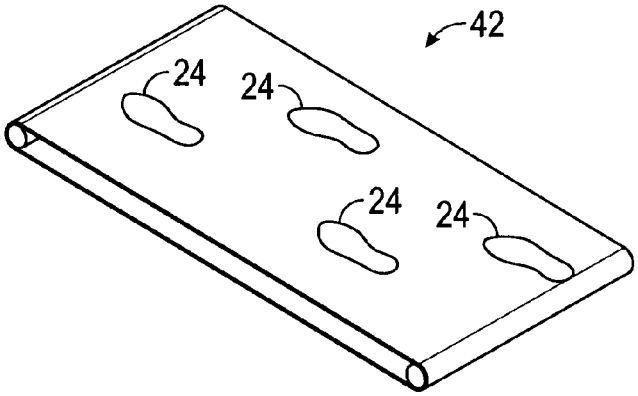
FIG. 7B is a perspective view of the belt illustrated in FIG. 7A having multiple step patterns of the stride pattern positioned on the belt.

FIGS. 7A and 7B illustrate another exemplary embodiment of a stride stretch system 10*d*. Generally, the stride stretch system 10*d* may include a treadmill 40 outfitted with a belt 42 (e.g., moveable belt) having one or more stride patterns 22 positioned thereon. Any commercially available treadmill 40 may be used.

Referring to FIGS. 4 and 7A, the stride patterns 22 may be permanently or temporarily positioned on the belt 42. For example, in some embodiments, the step patterns 24 of the stride pattern 22 may include an adhesive backing configured to be attached to the belt 42 and subsequently removed. Temporary positioning of the stride patterns 22 may allow for a user to gradually increase the distance $D_2$ of the extended step length by increasing the interval 26 of the stride pattern 22 for multiple sessions. Alternatively, one or more step patterns 24 may be permanently attached and/or displayed on the belt 42. For example, in some embodiments, the first step pattern 24 may be permanently positioned on the belt 42 (e.g., painted thereon, attached thereto). Subsequent step patterns 24 of the stride pattern 22 may be temporarily positioned on the belt 42. Alternatively, all step patterns 24 of the stride pattern 22 may be permanently positioned on the belt 42.

Figure 8A:
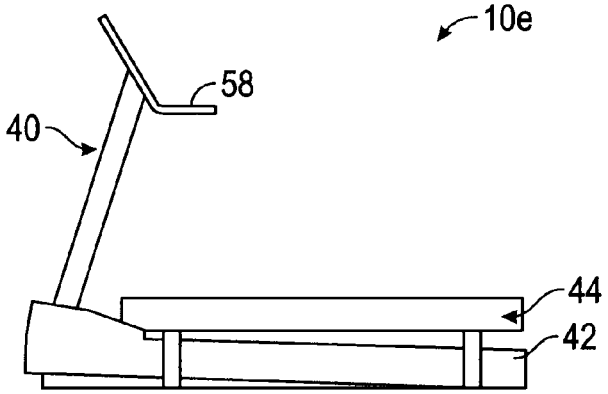
FIG. 8A is a side view of another exemplary stride stretch system in accordance with the present disclosure. The stride stretch system having a treadmill with a projection system for providing an image of a stride pattern on a belt of the treadmill.
Figure 8B:
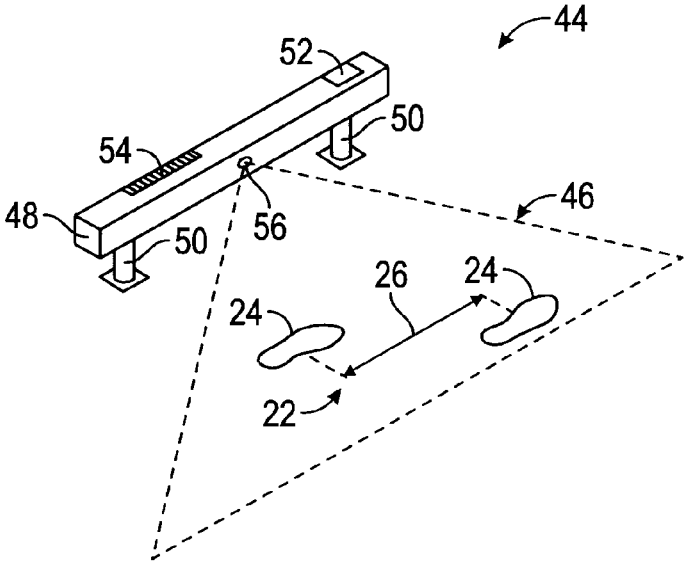
FIG. 8B is a diagrammatic view of an exemplary projection system for use in the stride stretch system illustrated in FIG. 8A.

FIGS. 8A and 8B illustrate another exemplary embodiment of a stride stretch system 10*e* using the treadmill 40. Generally, the stride stretch system 10*e* may include a projector system 44. The projector system 44 may be configured to project one or more images 46 on the belt 42 of the treadmill 40. The one or more images 46 projected on the belt 42 may include the stride pattern 22 having one or more step patterns 24 positioned at one or more intervals 26 as described herein.

In some embodiments, the projector system 44 may be configured to project one or more rays of light forming the image 46 of the stride pattern 22. The projector system 44 may include a housing 48 with one or more mounting legs 50. The mounting legs 50 may be configured to provide temporary or permanent positioning of the housing 48 on the treadmill 40.

In some embodiments, the projector system 44 may include one or more input devices 52, one or more control units 54 and one or more output devices 56. The input device 52, control unit 54 and the output devices 56 may be housed in a single device (e.g., housing 48) or may be housed in separate devices. For example, in FIG. 8B the input device 52, control unit 54 and the output devices 56 are within the housing 48. Alternatively, the input device 52, control unit 54 and/or output devices 56 may be positioned on or near handlebars 58 of the treadmill 40. Additionally, although the projector system 44 is shown positioned along the belt 42 of the treadmill 40, it should be apparent that the image 46 may be projected on the belt 42 from another location, such as the handlebars 58, and as such, the projector system 44 may be mounted on the handlebars 58. Generally, the projector system 44 may be mounted in any suitable position about the treadmill 40 to project the image 46 on the belt 42 without hindering movement of a user.

The one or more input devices 52 may be configured to receive information input from a user and/or processor(s), and transmitting such information to the control unit 54. The input device 52 may include, but is not limited to, implementation as a touchscreen, keyboard, mouse, trackball, microphone, fingerprint reader, infrared port, slide-out keyboard, flip-out keyboard, cell phone, PDA, video game controller, remote control, fax machine, network interface, combinations thereof, and the like, for example. In some embodiments, the input device 52 may be a touchscreen positioned on the display screen 60 of the treadmill, for example. In some embodiments, the input device 52 may be a cell phone configured to transmit communications to the control unit 54 of the projector system 44, for example. In some embodiments, the input device 52 may be a touchscreen positioned on the housing 48 of the projector system 44 as illustrated in FIG. 8B.

The control unit 54 may be a system or systems that are able to embody and/or execute the logic of the processes described herein. The control unit 54 may include one or more processors and processor executable code. As will be understood by persons of ordinary skill in the art, the control unit 54 may include one or more non-transient memory comprising processor executable code and/or software application, for example. In some embodiments, the control unit 54 may be configured to interface with a network to communicate information and/or data between the input device 52 and/or the output devices 56.

In some embodiments, the output device 56 may be any lens system capable of optomechanically projecting the image 46 on the belt 42 of the treadmill 40. Generally, the input device 52 may receive information on the extended step length and transmit the information and/or data to the control unit 54. The control unit 54 may analyze and determine the interval 26 for the step pattern 24 and project, using the output devices 56 the stride pattern 22 on the belt 42 of the treadmill 40.

In some embodiments, the output device 56 may include virtual reality glasses, goggles, headset, and/or any other type of wearable device configured to project the image 46 on the best 42 of the treadmill 40. For example, the output device 56 may project the image 46 in a virtual reality environment and/or physically on the ground. In some embodiments, the projection system 44 may be used separate from the treadmill 40. For example, the projection system having virtual reality glasses as the output device 56 may be capable of projecting the image 46 as the user walks on the ground (i.e., without the use of the treadmill 40).

Figure 9A:
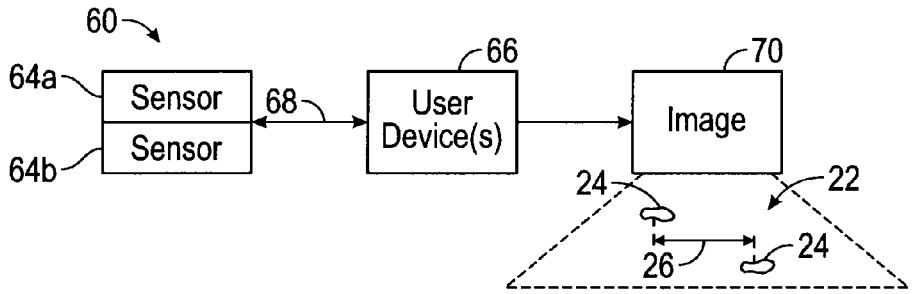
FIG. 9 A is a block diagram of a stride stretch system in accordance with the present disclosure.
FIG. 9B is a side view of the stride stretch system in accordance with the present disclosure.
Figure 9B:
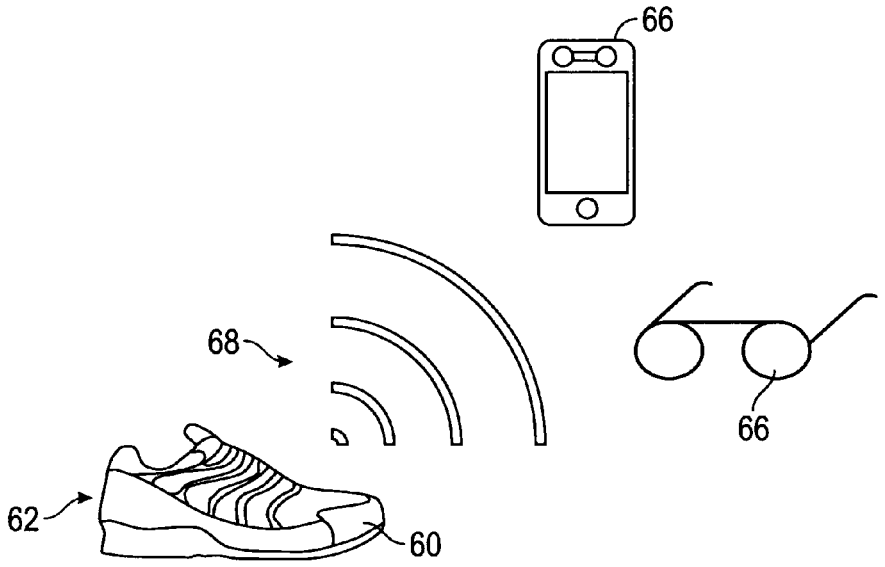

FIGS. 9A and 9B illustrate another exemplary embodiment of a stride stretch system 10*f* having one or more tracking devices 60 housed within one or more lower body wearable devices 62 (e.g., shoe(s), ankle bracelet(s)). Generally, the tracking device(s) 60 may communicate with a processor 64 and provide information, directly or indirectly, in the form of one or more signals to a user indicative of a real-time location of a user's feet as the feet contact a training surface, such as a ground, track or treadmill, for example. The signals may alert a user to positioning of feet in relation to a stride pattern 22, time intervals for one or more sessions, distance parameters for one or more sessions as described in detail in relation to FIGS. 1-8. The tracking device(s) 60 may be used with the embodiments described in relation to FIGS. 1-8, or the tracking device(s) 60 may be used as a stand-alone device.

The tracking device 60 may include one or more sensors 64 capable of receiving information regarding placement and/or positioning of one or more lower body wearable devices 62 (e.g., shoes) of a user. In some embodiments, the one or more sensors 64 may include a 3-axis accelerometer, GPS system, and/or the like that obtains and generates a series of data points that are indicative of and provide a real-time position of one or more lower body wearable devices 62 of a user. The tracking device 60 may be configured to provide information and/or data related to frequency, duration, intensity, pattern of movement, and location of the lower body wearable device(s) 62, which can then be correlated with a real-time location of the user's feet.

For example, if the lower body wearable device 62 is located on the user's shoe, then the real-time location of the user's feet would be the location of the lower body wearable device(s) 62. When the lower body wearable device(s) 62 is in the form of an anklet, then the real-time location of the user's feet would be a pre-selected distance in front of the lower body wearable device(s) 62. In some embodiments, the stride stretch system 10*f* includes two of the lower body wearable device(s) with each of the lower body wearable devices 62 configured to be attached to either an ankle of a shoe of the user. For example, the lower body wearable device 62 can have a housing with an opening to receive a shoe lace of the user's shoe.

The tracking device 60 may be permanently housed within the lower body wearable device(s) 62 or temporarily attached to the device 62. In some embodiments, the tracking device 60 may be positioned within a sole of the shoe, for example. It should be noted that the tracking device 60 may be positioned on any part of the lower body wearable device 62 and calibrated for positioning therefrom as will be understood by one skilled in the art. Alternatively, the tracking device may be positioned about one or more ankles of a user (e.g., ankle bracelet).

In some embodiments, the tracking device 60 may transmit information and/or data to one or more user devices 66 via communication link 68. In some embodiments, the communication link 68 may be a network. As used herein, the terms "network" and "cloud", and any variations thereof, are intended to include the provision of configurable computational resources on demand via interfacing with a processor, with software and/or data at least partially located on the processor.

The one or more user devices 66 may include, but are not limited to implementation as a cellular telephone, personal computer, a smart phone, network-capable television set, a television set-top box, a tablet, an e-book reader, a laptop computer, a desktop computer, a network-capable handheld device, a video game console, a server, a digital video recorder, a DVD-player, a Blu-Ray Player, and/or the like.

Additionally, in some embodiments, the one or more user devices 66 may include virtual reality glasses, goggles, headset, and/or any other type of wearable device capable of projecting an image 70 in a virtual reality environment or physically on the ground. The image 70 may include the stride pattern 22 as described in further detail herein showing a real-time location of the user's feet as determined by the information generated by the tracking device 60, as well as an expected position for placing the feet of the user as determined by the user device 66 so that the user can see the location of their feet relative to the expected position for assisting in extending the stride of the user.

The user device 66 may include one or more processors capable of interfacing with the communication link 68, processor executable code, one or more application capable of communicating information and/or data over the communication link 68, and/or the like. As will be understood by persons of ordinary skill in the art, the user device 66 may include one or more non-transient memory comprising processor executable code and/or software applications, for example.

In some embodiments, the user device 66 may be configured to provide one or more alert signals (e.g., vibration, auditory, visual) to the user. For example, the user device 66 may be configured to provide a vibration alert signal to the user when correct positioning of the user's feet according to a pre-determined stride pattern 22 is achieved. In another example, the user device 66 may be configured to provide an auditory signal to the user when completion of a pre-determined distance of the stride pattern 22 has been achieved. In another example, the user device 66 may be configured to provide a visual signal to the user when completion of a pre-determined timed session of the stride pattern 22 has been achieved.

From the above description, it is clear that the inventive concept(s) disclosed herein are well adapted to carry out the objects and to attain the advantages mentioned herein, as well as those inherent in the inventive concept(s) disclosed herein. While the embodiments of the inventive concept(s) disclosed herein have been described for purposes of this disclosure, it will be understood that numerous changes may be made and readily suggested to those skilled in the art which are accomplished within the scope and spirit of the inventive concept(s) disclosed herein.

What is claimed is:

1. A stretch stride system, comprising:

a mat having a first stride pattern and a second stride pattern positioned thereon prior to positioning of a user's foot on the first stride pattern or the second stride pattern, the first stride pattern including two or more step patterns spaced at a first interval, the second stride pattern including two or more step patterns spaced at a second interval, wherein the first interval and the second interval are different and determined using different extended step lengths that are longer than a user's normal step length to promote deliberate over-extension.

2. The system of claim 1, wherein the mat has a first end and a second end with the first stride pattern extending from the first end to the second end of the mat.

3. The system of claim 2, wherein the mat has a first side and a second side with the first stride pattern positioned at the first side of the mat and the second stride pattern positioned adjacent to the first stride pattern and extending from the first end to the second end of the mat.

4. The system of claim 3, wherein the mat includes additional stride patterns having different intervals.

5. The system of claim 1, wherein the first interval is a distance less than the second interval.

6. The system of claim 1, wherein the step patterns of the first stride pattern have a first marking and the step patterns of the second stride pattern have a second marking different than the first marking.

7. The system of claim 1, wherein the different extended step lengths that are longer than a user's normal step length increase the user's normal step length between 120%-160%.

* * * * *